US005444472A

United States Patent [19]

Dué et al.

[11] Patent Number: 5,444,472

[45] Date of Patent: Aug. 22, 1995

[54] METHOD OF AND AN APPARATUS FOR USING AN INK CONCENTRATE IN AN INK JET PRINTING ARRANGEMENT

[75] Inventors: George B. Dué; John W. Standard, both of Pittsburgh; Anthony P. Pino, Butler; Michael E. OBrien, Greensburg; Thomas S. Pope, Monroeville, all of Pa.

[73] Assignee: Matthews International Corporation, Pittsburgh, Pa.

[21] Appl. No.: 117,426

[22] Filed: Sep. 7, 1993

[51] Int. Cl.[6] ..... B41J 2/175

[52] U.S. Cl. ..... 347/85; 347/84; 347/7

[58] Field of Search ..... 347/85, 7, 84

[56] References Cited

U.S. PATENT DOCUMENTS

| | | | |
|---|---|---|---|
| 3,835,881 | 9/1974 | Dal et al. | 347/7 |
| 3,930,258 | 12/1975 | Dick et al. | 347/7 |
| 4,067,020 | 1/1978 | Arway | 347/7 |
| 4,121,222 | 10/1978 | Diebold et al. | 347/7 |
| 4,196,437 | 4/1980 | Hertz | 427/426 |
| 4,614,953 | 9/1986 | Lapeyre | 347/7 |
| 4,827,278 | 5/1989 | Lecheheb | 347/7 |
| 4,987,429 | 1/1991 | Finley et al. | 347/85 |
| 5,255,022 | 10/1993 | Burolla | 347/85 |

FOREIGN PATENT DOCUMENTS 0266344 1/1991 European Pat. Off. .

*Primary Examiner*—Benjamin R. Fuller
*Assistant Examiner*—Valerie Ann Lund
*Attorney, Agent, or Firm*—James Ray & Associates

[57] ABSTRACT

An apparatus is provided which enables ink used in a print head disposed in an ink jet printing arrangement to be produced, in situ, from an ink concentrate and a diluting agent. Such apparatus includes a generally hollow fluid-tight housing member. A collapsible ink concentrate container is provided for containing a predetermined volume of ink concentrate therein. The container is disposed in an interior portion of such housing member. A connection is disposed on the housing member and in fluid communication with the interior portion of such housing member for connecting the housing member to a source of fluid pressure. An ink concentrate fluid communication passageway is connected to the ink concentrate container for communicating a predetermined volume of ink concentrate to a mixing apparatus. A fluid communication is established for communicating a diluting agent from the interior portion of such housing member to the mixing apparatus.

20 Claims, 5 Drawing Sheets

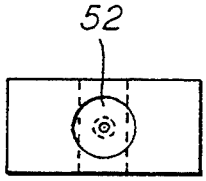
FIG. 7C
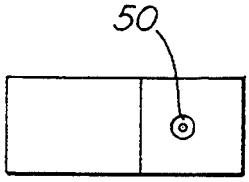
FIG. 7A
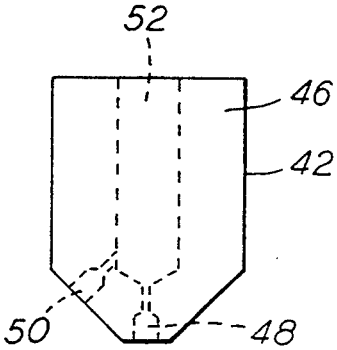
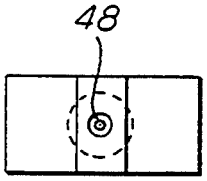
FIG. 7B
FIG. 7

METHOD OF AND AN APPARATUS FOR USING AN INK CONCENTRATE IN AN INK JET PRINTING ARRANGEMENT

FIELD OF THE INVENTION

The present invention relates, in general, to ink which is communicated to at least one print head disposed in an ink jet printing arrangement and, more particularly, this invention relates to a method of and an apparatus for making such ink, in situ, in such ink jet printing arrangement from an ink concentrate and a preselected diluting agent.

BACKGROUND OF THE INVENTION

Prior to the present invention, ink jet printing has been in use in industry for several years. These ink jet printing arrangements have normally utilized a premixed ink ready, as received, for delivery to the printing head. Such premixed ink being communicated by a pump to the print head disposed in such ink jet printing arrangement. As is well known, pumps are generally difficult and costly to maintain due to their numerous moving components.

Applicants are aware of only one ink jet printing arrangement which does not require the use of a pump. This prior art system utilizes a series of elastic members surrounding a container of premixed ink. These elastic members are capable of forcing the ink from the container to the print head disposed in the printing arrangement. However, this system requires over filling of the ink container. The reason such over filling is required is because the force being exerted by the elastic members will obviously decrease as more and more ink is communicated from the container. In addition to the wasted ink, these containers are always thrown away. This, therefore, adds to the printing cost.

Applicants are also aware of European Patent No. 0 266 344 which teaches a fluid jet printing device. This device utilizes a fluid container which supplies a premixed ink to the printing device. Such container is filled with ink and a pressurized gas. The container has an outlet which is adapted to be detachably connected to an inlet port of the printing device. As with other prior art devices, this container is non-refillable and, therefore, costly to use.

Further, such premixed inks normally used in ink jet printing are solvent based and, therefore, present. a number of undesirable problems from an environmental standpoint and oftentimes from a safety standpoint. Obviously the extent of these problems will depend to a large extent on the solvent being used to produce the ink.

Furthermore, because the inks used prior to the present invention were ready for use when shipped, the cost of shipping the ink have generally been high.

Further, adding to the cost of prior art premixed ink used in ink jet printing is that, generally, the shipping containers for the ink are non-returnable. In some cases, disposal of these shipping containers can be a potential problem depending on the solvent used. Applicants are not aware of any equipment commercially available which provides a capability of using an ink concentrate to produce an ink, in situ, that is suitable for use in an ink jet printing head.

It is well known that these ink jet printing arrangements are oftentimes used in high speed, high production assembly lines. As a result, when prior art printing arrangements ran out of ink it was necessary to stop the production line until additional ink supplies could be added. This obviously is costly due to the lost production.

SUMMARY OF THE INVENTION

In a first aspect, the present invention provides an apparatus which enables ink used in a print head in an ink jet printing arrangement to be produced, in situ, from an ink concentrate and a diluting agent. The apparatus includes a generally hollow fluid-tight housing member capable of withstanding a predetermined pressure being exerted outwardly thereon. A collapsible ink concentrate container means is provided for containing a predetermined volume of ink concentrate therein. This collapsible ink concentrate container means is disposed in an interior portion of the housing member. A means is disposed on such housing member and in fluid communication with the interior portion thereof for connecting the housing member to a source of fluid pressure. An ink concentrate fluid communication passageway is connected to the ink concentrate collapsible container means for communicating a predetermined volume of ink concentrate to a mixing apparatus. A diluting agent communication means is provided for communicating a preselected diluting agent from such interior portion of the housing member to the mixing apparatus.

In a second aspect of this invention, there is provided a housing member for an apparatus used to make ink, in situ, in an ink jet printing arrangement. Such housing member includes a generally hollow fluid-tight body portion capable of withstanding a predetermined pressure being exerted outwardly thereon. An access means is connected to the body portion of the housing member in a fluid-tight manner for providing access to the interior portion of the housing member. A first connection means is connected to one of such access means and the body portion of the housing member for connecting the interior portion of such housing member to a source of fluid pressure. A second connection means is connected to one of such access means and such body portion for communicating one of ink concentrate to a mixing apparatus and ink from the mixing apparatus to a print head disposed in such ink jet printing arrangement.

In a third aspect, the present invention provides a manifold for receiving an ink concentrate and a preselected diluting agent used to dilute such ink concentrate and delivering a mixture of such ink concentrate and such diluting agent to a mixer apparatus to produce an ink in situ. The ink produced in this manner is used in at least one print head disposed in an ink jet printing arrangement. Such manifold includes a body portion having a first fluid communication passageway formed therein for receiving a predetermined volume of such ink concentrate. A diluting agent communication passageway is formed in such body portion for receiving a predetermined volume of fluid to be mixed with the ink concentrate and the diluting agent. Such first fluid communication passageway and such diluting agent communication passageway are sized to provide a predetermined amount of ink concentrate and diluting agent to be mixed with such ink concentrate in the mixing apparatus, respectively, to provide an ink suitable for use in at least one print head of an ink jet printer. A second fluid communication passageway is formed in the body portion of the manifold. The second fluid communication passageway is in fluid communication with each of such first fluid communication passageway and such diluting agent communication passageway to deliver the ink concentrate and the diluting agent used to dilute the ink concentrate to the mixer apparatus. A first connection means is engaged with the first fluid communication passageway for connecting a source of ink concentrate to the manifold. A second connection means is engaged with the second fluid communication passageway for connecting such second fluid communication passageway for delivering the ink concentrate and such diluting agent to such mixing apparatus.

In a fourth and final aspect, the present invention provides a method of producing ink from an ink concentrate and a preselected diluting agent, in situ, in an ink jet printing arrangement. The method includes the steps of disposing a predetermined volume of a predetermined ink concentrate in a collapsible container means. Thereafter, disposing such collapsible container means, containing the ink concentrate therein, in a generally hollow fluid-tight housing member. Then connecting such collapsible container means containing the ink concentrate for fluid communication of such ink concentrate to a mixing apparatus. Connecting a source of fluid pressure to an interior portion of the generally hollow fluid-tight housing member. Supplying a predetermined fluid pressure to such interior portion of the generally hollow fluid-tight housing member for collapsing such collapsible container means and thereby forcing such ink concentrate from such collapsible container means and communicating the ink concentrate to the mixing apparatus and communicating a predetermined diluting agent to such mixing apparatus to mix with and dilute the ink concentrate and produce an ink suitable for use in at least one print head disposed in the ink jet printing arrangement.

OBJECTS OF THE INVENTION

It is, therefore, one of the primary objects of the present invention to provide a method of and an apparatus for producing ink, in situ, in an ink jet printing arrangement which utilizes an ink concentrate and a preselected diluent.

Another object of the present invention is to provide a method of and an apparatus for producing ink, in situ, in an ink jet printing arrangement which eliminates the need for a pump to deliver the ink to the print head.

Still another object of the present invention is to provide a method of and an apparatus for producing ink, in situ, in an ink jet printing arrangement in which the housing member of the apparatus simultaneously serves as a shipping container for the ink concentrate.

Yet another object of the present invention is to provide a method of and an apparatus for producing ink, in situ, in an ink jet printing arrangement which reduces the maintenance requirements for such ink jet printing arrangement.

A further object of the present invention is to provide a method of and an apparatus for producing ink, in situ, in an ink jet printing arrangement which is relatively inexpensive to produce.

An additional object of the present invention is to provide a method of and an apparatus for producing ink, in situ, in an ink jet printing arrangement in which the apparatus can be reused.

Still yet another object of the present invention is to provide a method of and an apparatus for producing ink, in situ, in an ink jet printing arrangement which is environmentally safe.

It is an additional object of the present invention is to provide a method of and an apparatus for producing ink, in situ, in an ink jet printing arrangement which utilizes fluid pressure for moving both the ink concentrate and the diluting agent to a mixing apparatus.

A corollary to the above object of the present invention is to provide a method of and an apparatus for producing ink, in situ, in an ink jet printing arrangement in which the fluid pressure used to force the ink concentrate to the mixing apparatus is water pressure and the water can be used to dilute the ink concentrate in the mixing apparatus.

Yet still another object of the present invention is to provide a method of and an apparatus for producing ink, in situ, in an ink jet printing arrangement which is relatively easy to operate.

A still further object of the present invention is to provide a method of and an apparatus for producing ink, in situ, in an ink jet printing arrangement which is cost effective to the end user of the apparatus.

Another significant object of the present invention is to provide a method of and an apparatus for producing ink, in situ, in an ink jet printing arrangement which is capable of allowing continuous operation of an ink jet printing arrangement in a production line.

These and various other objects and advantages of the present invention will become more readily apparent to those persons who are skilled in the ink jet printing art from the following more detailed description of the invention, particularly, when such description is taken in conjunction with the attached drawing Figures and the appended claims.

BRIEF DESCRIPTION OF THE DRAWINGS

FIG. 7 is a plan view of a presently preferred manifold used in the present invention, having still another different ratio; and FIG. 7*a–c* are side views of the manifold illustrated in FIG. 7.

Figure 1:
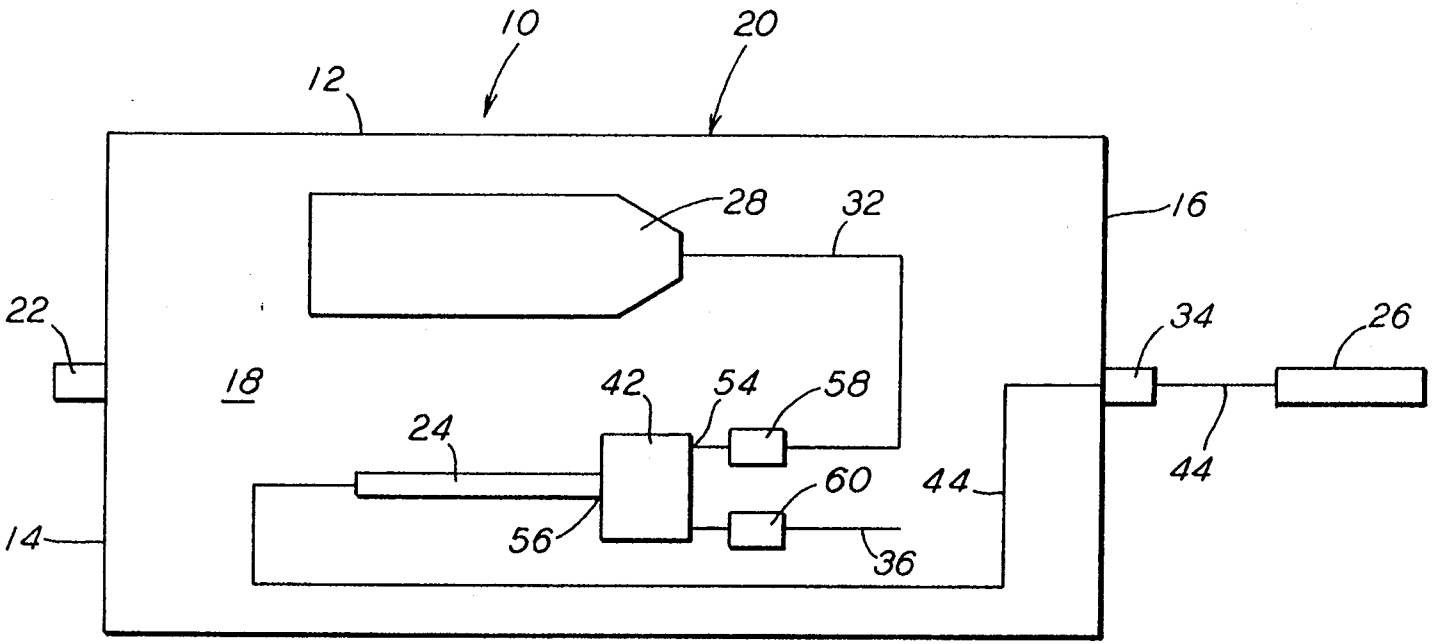
FIG. 1 is a schematic diagram illustrating a presently preferred embodiment of the invention.

DESCRIPTION OF THE PRESENTLY PREFERRED AND ALTERNATIVE EMBODIMENTS OF THE INVENTION

Prior to proceeding to a more detailed description of the instant invention it should be noted that, for the sake of clarity, identical components, having identical functions, have been identified with identical reference numerals throughout the several views of the drawings.

Now refer more particularly to FIG. 1. Illustrated therein is a presently preferred embodiment of an apparatus which provides the capability of producing, in situ, ink used in a print head disposed in an ink jet printing arrangement. Such ink being produced from an ink concentrate and a preselected diluting agent.

As used in the present application the term "diluting agent" may be in some cases a solid, water, solvents or a mixture of water and solvents. As will become clear to those persons skilled in the art, as the description proceeds, water is the most preferred diluting agent.

The apparatus, generally designated 10, includes a generally hollow and fluid-tight housing member, generally designated 20. Such housing member 20 may have any number of configurations all of which must be capable of withstanding pressure being exerted thereon. In the presently preferred embodiment of the invention, housing member 20 will normally include an elongated generally round hollow body portion 12. In this case a first end closing means 14 is connected to the body portion 12 of housing member 20 for closing a first end of such housing member 20 in a fluid-tight manner. The first end closing means 14 may be and preferably is removably engaged with such body portion 12. Alternatively, such first end closing means 14 may be formed integrally with the body portion 12 of housing member 20.

Housing member 20 further includes a second end closing means 16 which is connected to body portion 12 of housing member 20 for closing a radially opposed second end of such housing member 20 in a fluid-tight manner. As discussed above with respect to the first end closing means 14, the second end closing means 16 may be and preferably is removably engaged with the body portion 12 of housing member 20. Alternatively, the second end closing means 16 may be formed integrally with body portion 12.

An access means (not shown) is connected to the body portion 12 of housing member 20 in a fluid-tight manner to provide the necessary access to an interior portion 18 of such housing member 20. The access means may be provided by having at least one of the first end closing means 14 and the second end closing means 16 removably engaged with the body portion 12 of housing member 20. Alternatively, the body portion 12 of housing member 20 may be formed in at least two pieces (not shown) and a coupling (not shown) provided to hold the two pieces together and serve as a means for gaining access to the interior portion 18 of the housing member 20. In the event another configuration for housing member 20, for example, a box-like shape, the access means may be a lid which can be secured to the body portion.

In the presently preferred embodiment of the invention, housing member 20 will include a first connection means 22 for connecting the interior portion 18 of housing member 20 to a source of fluid pressure (not shown in FIG. 1). Such first connection means 20 may be connected to either the first end closing means 14 or to the body portion 12 of housing member 20. Preferably, the first connection means 22 will be connected to such first end closing means 14.

A second connection means 34 is provided to communicate at least one of a preselected ink concentrate to a mixing apparatus 24 (FIGS. 2 and 3) and an ink from such mixing apparatus 24 (FIG. 1) to at least one print head 26 (FIG. 2) disposed in an ink jet printing arrangement.

When either one or both of the first and second end closing means 14 and 16 are removable, a sealing means (not shown) is provided to ensure a fluid-tight housing member 20. In the case where both the first and the second end closing means 14 and 16 are not removable and a separate access means is provided, such separate access means will also include a sealing means (not shown) to ensure a fluid-tight housing member 20.

The apparatus 10 further includes a collapsible ink concentrate container means 28. Collapsible ink container means 28 contains a predetermined volume of a preselected ink concentrate therein and is disposed in the interior portion 18 of the housing member 20. In the presently preferred embodiment of the invention, the ink container means 28 will be a plastic bag.

Apparatus 10 has a means 22 disposed on the first end closing means 14 and in fluid communication with the interior portion 18 of the housing member 20. Means 22 connects the interior portion 18 to a predetermined source of fluid pressure. In the presently preferred embodiment of the invention, such source of fluid pressure is tap water. It should also be understood that means 22 could be connected for such fluid communication with the interior portion 18 of the housing member 20 by placing it on such body portion 12. The means 22 will preferably be a friction fit type connection regardless of its position.

An ink concentrate fluid communication passageway 32 is connected to the ink concentrate container means 28. Ink concentrate fluid communication passageway 32 communicates a predetermined volume of a preselected ink concentrate to the mixing apparatus 24. In the presently preferred embodiment, as illustrated in FIG. 1, the mixing apparatus 24 is disposed within the interior portion 18 of such housing member 20. However, it is still within the scope of the instant invention for such mixing apparatus 24 to be located outside of such housing member 20, as illustrated in FIG. 2.

The final essential element, of the present invention, is a diluting agent communication means 36. Such diluting agent communication means 36 communicates the selected diluting agent from the interior portion 18 of housing member 20 to the mixing apparatus 24. The preferred diluting agent for use in the present invention is a purified tap water. It is even more preferred that such tap water used to dilute the ink concentrate be the water which provides the source of fluid pressure to the interior portion 18 of such housing member 20. In this case, the apparatus 10 will further include a filtering means 38 for filtering the tap water prior to entry into the interior portion 18 of the housing member 20, as illustrated in FIG. 2.

Figure 2:
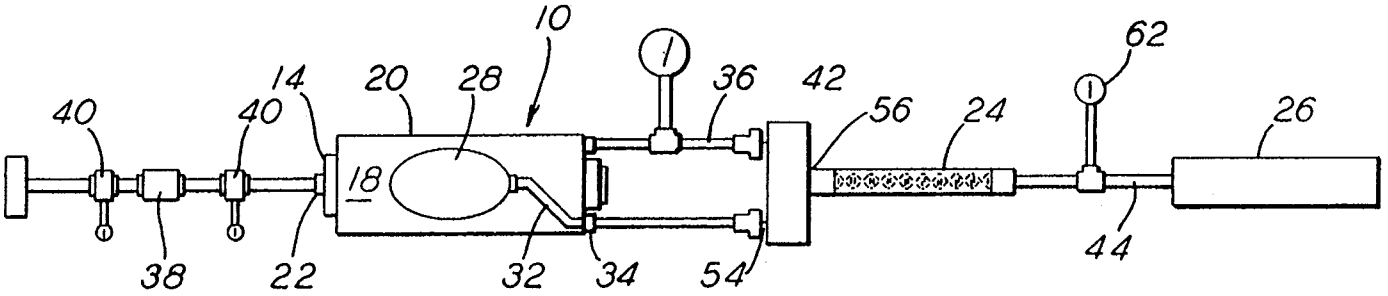
FIG. 2 is a schematic diagram illustrating an alternative embodiment of the present invention.
Figure 3:
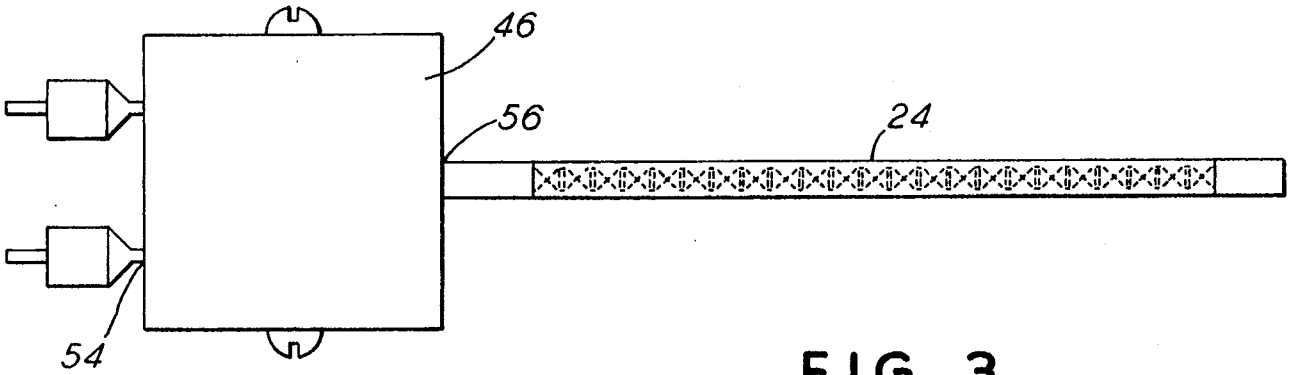
FIG. 3 is a plan view of a manifold and mixing apparatus assemble used in the present invention.

Additionally, as shown in FIG. 2, apparatus 10 will preferably include a means 40 for regulating the pressure of the tap water before it enters the interior portion 18 of housing member 20, when such water provides both the source of fluid pressure and serves as the preselected diluting agent for the ink concentrate.

Preferably, the apparatus 10 will also include a manifold 42. Such manifold 42 although not critical will preferably be disposed within the interior portion 18 of housing member 20 intermediate the mixing apparatus 24 and the ink concentrate fluid communication passageway 32. Such manifold 42 delivering each of the selected diluting agent and the ink concentrate to the mixing apparatus 24.

In the presently preferred embodiment of the invention, such mixing apparatus 24 is a static mixer. The static mixer 24 includes a means 44 for connecting a supply of ink produced therein to at least one print head 26 disposed in the ink jet printing arrangement.

Another important feature of the apparatus 10 is that it is not only reusable but it can also serve as a shipping container for the ink concentrate, thereby reducing both the packaging and shipping cost.

The manifold 42, for receiving the preselected ink concentrate and the selected diluting agent and delivering the mixture of such ink concentrate and diluting agent to the mixing apparatus 24, as seen in each of the several views of the drawings, includes a body portion 46 having a predetermined configuration. Body portion 46 of manifold 42 includes a first fluid communication passageway 48 formed therein for receiving and communicating a predetermined volume of the selected ink concentrate.

The body portion 46 of manifold 42 further includes a communication passageway 50 formed therein. This communication passageway 50 receives and communicates a predetermined volume of the selected diluting agent to be mixed with the ink concentrate. The first fluid communication passageway 48 and the diluting agent communication passageway 50 are equipped to provide a predetermined amount of the ink concentrate and the diluting agent which is to be mixed with the ink concentrate, respectively, to the mixing apparatus 24 to ensure an ink suitable for use in such at least one print head 26 disposed in the ink jet printing arrangement.

A second fluid communication passageway 52 is formed in the body portion 46 of manifold 42. Such second fluid communication passageway 52 is in fluid communication with each of the first fluid communication passageway 48 and the diluting agent communication passageway 50. Such second fluid communication passageway 52 communicates the preselected ink concentrate and the selected diluting agent to mixing apparatus 24.

A first connection means 54 is engaged with the first fluid communication passageway 48 for connecting line 32, which line 32 is the source of ink concentrate, to the manifold 42.

The final essential element of the manifold 42 is a second connection means 56 engaged with the second fluid communication passageway 52 for communicating the ink concentrate and diluting agent to mixing apparatus 24. In the presently preferred embodiment of the invention, such first connection means 54 and such second connection means 56 are friction fit type connections.

The manifold 42, in the presently preferred embodiment of the invention, is plastic, which is molded with each of the first fluid communication passageway 48, the diluting agent communication passageway 50, the second fluid communication passageway 52, the first connection means 54 and the second connection means 56 being molded simultaneously into the body portion 46 of manifold 42.

In the presently preferred embodiment, as seen in FIG. 1, check valves 58 and 60 are provided to control, respectively, back flow of ink concentrate and diluting agent from the manifold 42. Such back flow could occur, for example, when the apparatus 10 is idle. Additionally, as seen in FIG. 2, a regulator 62 may be positioned intermediate the static mixture 24 and the print head 26 to control the flow of ink from the static mixer 24 to the print head 26.

Figure 4:
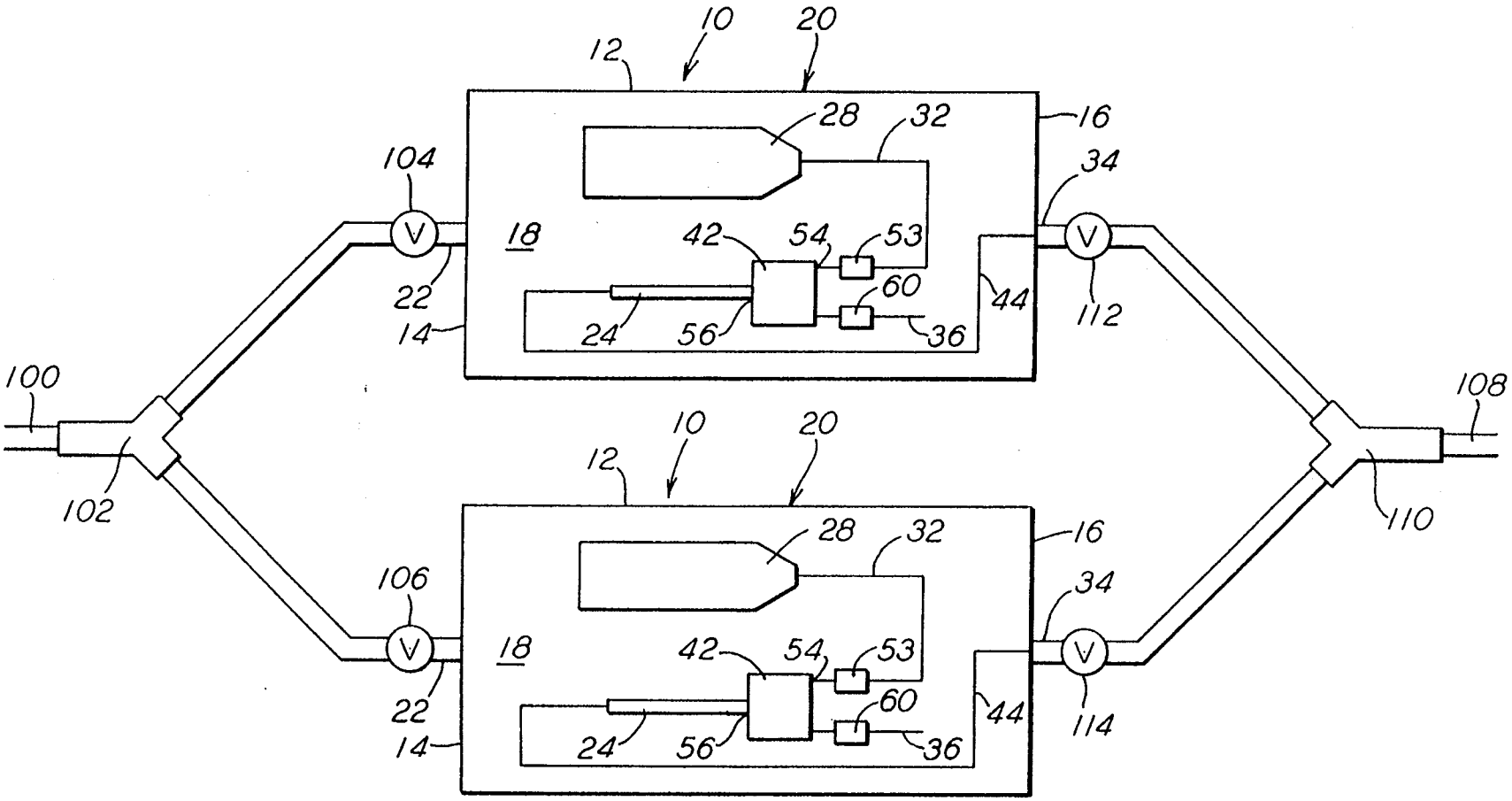
FIG. 4 is a schematic diagram illustrating an arrangement which permits continuous operation of an ink jet printing arrangement in a production facility.
Figure 5C:
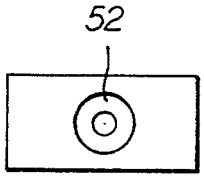
FIG. 5*a–c* are side views of the manifold illustrated in FIG. 5.
Figure 5A:
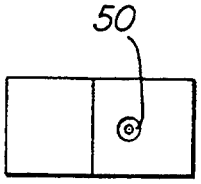
Figure 5:
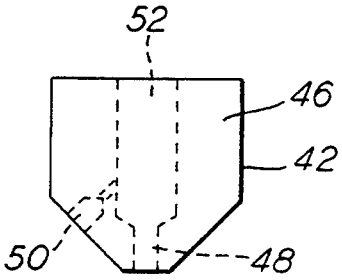
FIG. 5 is a plan view of a presently preferred manifold used in the present invention.
Figure 5B:
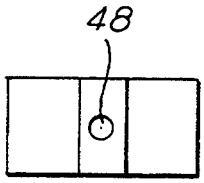
Figure 6C:
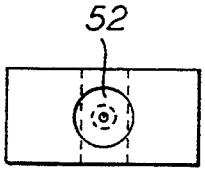
FIG. 6*a–c* are side views of the manifold illustrated in FIG. 6.
Figure 6A:
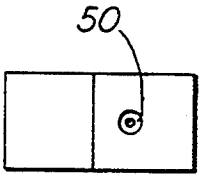
Figure 6:
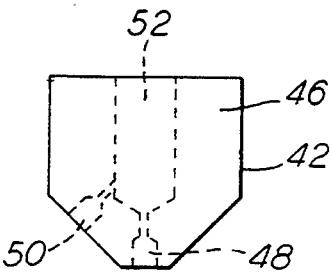
FIG. 6 is a plan view of still another presently preferred manifold used in the present invention, having a different ratio.
Figure 6B:
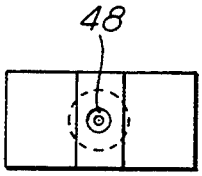

As can be seen in FIG. 4, the present invention is capable of providing a significant advantage to production equipment by providing an ink jet printing arrangement that is capable of supplying uninterrupted ink to at least one print head disposed in such ink jet printing arrangement. For the sake of brevity, all of the elements of apparatus 10 will not be repeated here as they are evident from FIG. 4 and the detailed description above. In this arrangement a pair of apparatuses 10 are positioned in a production line with a common source of fluid pressure 100 being provide to a Y connection 102 for communicating a predetermined pressure through a valve 104 or 106 to an interior portion 18 of a respective housing member 20. Ink is supplied to a line 108 connected to a Y connection 110 through either valve 112 or 114. In all cases, when valve 104 and 112 are open valves 106 and 114 will be closed and when valves 106 and 114 are open valves 104 and 112 will be closed. This arrangement provides numerous advantages to the user by insuring a continuous supply of ink. Furthermore, when an ink container 28 disposed in one apparatus 10 is empty and ink is being supplied from the ink container 28 disposed in the second apparatus 10 the first apparatus 10 can be replaced and vice versa.

According to the method of producing an ink from an ink concentrate and a preselected diluting agent, in situ, in an ink jet printing arrangement with the apparatus 10, a predetermined volume of a predetermined ink concentrate is first disposed in the collapsible container means 28. Such collapsible container means 28, containing the ink concentrate therein, is disposed in the interior portion 18 of a generally hollow fluid-tight housing member 20. The collapsible container means 28 is connected for fluid communication of the ink concentrate from the collapsible container means 28 to a mixing apparatus 24. A source of fluid pressure, preferably pressure supplied by tap water, is connected to the interior portion 18 of the generally hollow housing member 20. It should be understood that the disposing of the collapsible container means 28 in the housing member 20, the connecting of the container means 28 to mixing apparatus 24 and the connecting of the fluid pressure source to the housing member 20 may be carried out in any convenient order. Thereafter, a predetermined fluid pressure is supplied to the interior portion 18 of the housing member 20 for collapsing such container means 28 and thereby forcing the ink concentrate from the collapsible container means 28 and communicating the ink concentrate through fluid communication passageway 32 to the mixing apparatus 24. Simultaneously, a predetermined diluting agent, preferably tap water, is communicated to the mixing apparatus 24 to be mixed with the ink concentrate and produce an ink. The ink thus produced is suitable for use in at least one print head 26 disposed in the ink jet printing arrangement.

While a number of presently preferred and alternative embodiments of the invention have been described in detail above it should be understood that those persons who are skilled in the ink making and ink jet printing art may make other modifications and adaptations of the invention without departing from the spirit and scope of the appended claims.

We claim:

1. An apparatus which provides a capability for ink, used in a print head disposed in an ink jet printing arrangement, to be produced, in situ, from an ink concentrate and a diluting agent, said apparatus comprising:

(a) a hollow fluid-tight housing member for containing a pressure exerted outwardly thereon;

(b) a collapsible ink concentrate container means for containing a volume of an ink concentrate therein disposed in an interior portion of said housing member;

(c) a means disposed on and in fluid communication with said interior portion of said housing member for connecting said housing member to a source of fluid pressure;

(d) an ink concentrate fluid communication passageway connected to said ink concentrate container means for communicating a volume of said ink concentrate to a mixing apparatus; and (e) a diluting agent communication means for communicating said diluting agent from said interior portion of said housing member to said mixing apparatus.

2. An apparatus, according to claim 1, wherein said housing serves as a reusable shipping container.

3. An apparatus, according to claim 1, wherein said source of fluid pressure is tap water.

4. An apparatus, according to claim 1, wherein said apparatus further includes means engaged with said source of fluid pressure for regulating said pressure.

5. An apparatus, according to claim 1, wherein said apparatus further includes said mixing apparatus disposed within said interior portion of said housing member.

6. An apparatus, according to claim 5, wherein said apparatus further includes a manifold disposed within said interior portion of said housing member intermediate said mixing apparatus and said ink concentrate communication passageway, said manifold delivering each of said diluting agent and said ink concentrate to said mixing apparatus.

7. An apparatus, according to claim 6, wherein said diluting agent is water.

8. An apparatus, according to claim 7, wherein said apparatus further includes means for purifying said water.

9. An apparatus, according to claim 5, wherein said mixing apparatus is a static mixer.

10. An apparatus, according to claim 9, wherein said static mixer includes means for connecting an ink supply to at least one print head disposed in an ink jet printing arrangement.

11. An ink jet printing arrangement disposed in a production line which has a dual ink supply for uninterrupted operation to at least one print head disposed in such ink jet printing arrangement, said ink jet printing arrangement comprising:

(a) a first hollow fluid-tight housing member for containing a pressure exerted outwardly thereon;

(b) a first collapsible ink concentrate container means for containing a volume of an ink concentrate therein disposed in an interior portion of said first housing member;

(c) a first means disposed on and in fluid communication with said interior portion of said first housing member for connecting said first housing member to a source of fluid pressure;

(d) a first ink concentrate fluid communication passageway connected to said first ink concentrate container means for communicating a volume of said ink concentrate to a first mixing apparatus;

(e) a first diluting agent communication means for communicating said diluting agent from said interior portion of said first housing member to said first mixing apparatus;

(f) a second hollow fluid-tight housing member for containing a pressure exerted outwardly thereon;

(g) a second collapsible ink concentrate container means for containing a volume of an ink concentrate therein disposed in an interior portion of said first housing member;

(h) a second means disposed on and in fluid communication with said interior portion of said second housing member for connecting said second housing member to a source of fluid pressure;

(i) a second ink concentrate fluid communication passageway connected to said second ink concentrate container means for communicating a volume of said ink concentrate to a second mixing apparatus;

(j) a second diluting agent communication means for communicating said diluting agent from said interior portion of said second housing member to said second mixing apparatus;

(k) a first valve means for controlling said source of fluid pressure to said interior portion of said first housing member;

(l) a second valve means for controlling said source of fluid pressure to said interior portion of said second housing member;

(m) a third valve means for controlling an ink supply from said first mixing apparatus to at least one print head disposed in said ink jet printing arrangement; and (n) a fourth valve means for controlling an ink supply from said second mixing apparatus to said at least one print head disposed in said ink jet printing arrangement.

12. A housing member for an apparatus used to produce ink, in situ, in an ink jet printing arrangement, said housing member comprising:

(a) a hollow body portion for containing a pressure exerted outwardly thereon;

(b) access means connected to said body portion of said housing member in a fluid-tight manner for providing access to an interior portion of said housing member;

(c) a first connection means connected to one of said access means and said body portion for connecting said interior portion of said housing member to a source of fluid pressure; and (d) a second connection means connected to one of said access means and said body portion for communicating one of an ink concentrate to a mixing apparatus and ink from said mixing apparatus to a print head disposed in such ink jet printing arrangement.

13. A housing member, according to claim 12, wherein said access means is removable.

14. A housing member, according to claim 13, wherein said body portion of said housing member includes a first end closing means connected to the body portion and a second end closing means connected to the body portion, at least one of which is removable.

15. A manifold for receiving a an ink concentrate and a diluting agent and delivering a mixture of said ink concentrate and said diluting agent to a mixer apparatus to produce an ink, in situ, for use in at least one print head disposed in an ink jet printing arrangement, said manifold comprising:

(a) a body portion;

(b) a first fluid communication passageway formed in said body portion for communicating a volume of said ink concentrate;

(c) a diluting agent communication passageway formed in said body portion for communicating a volume of said diluting agent for mixing with said ink concentrate, said first fluid communication passageway and said diluting agent communication passageway equipped to provide a volume of said ink concentrate and said diluting agent for mixing with said ink concentrate, respectively, to provide an ink for use in said at least one print head of said ink jet printing arrangement;

(d) a second fluid communication passageway formed in said body portion and in fluid communication with each of said first fluid communication passageway and said communication passageway for communicating said ink concentrate and said fluid diluting agent to said mixer apparatus;

(e) a first connection means engaged with said first fluid communication passageway for connecting a source of said ink concentrate to said manifold; and (f) a second connection means engaged with said second fluid communication passageway for connecting said second fluid communication passageway for communicating said ink concentrate and said diluting agent to said mixing apparatus.

16. A manifold, according to claim 15, wherein said first connection means and said second connection means are friction fits.

17. A manifold, according to claim 15, wherein said diluting agent is tap water.

18. A manifold, according to claim 15, wherein said manifold is plastic.

19. A manifold, according to claim 18, wherein said plastic is molded and each of said first fluid communication passageway and said second fluid communication passageway and said third fluid communication passageway and said first connection means and said second connection means is molded into said body portion of said manifold.

20. A method of producing ink from an ink concentrate, in situ, in an ink jet printing arrangement, said method comprising the steps of:

(a) disposing a volume of an ink concentrate in a collapsible container means;

(b) disposing said collapsible container means containing said ink concentrate therein in a hollow fluid tight housing member;

(c) connecting said collapsible container means containing said ink concentrate for fluid communication of said ink concentrate to a mixing apparatus;

(d) connecting a source of fluid pressure to an interior portion of said hollow fluid-tight housing member;

(e) supplying a fluid pressure to said interior portion of said hollow fluid-tight housing member for collapsing said collapsible container means and thereby forcing said ink concentrate from said collapsible container means and communicating said ink concentrate to said mixing apparatus; and (f) communicating a diluting agent to said mixing apparatus to mix with said ink concentrate and produce said ink for use in said at least one print head disposed in said ink jet printing arrangement.

* * * * *

UNITED STATES PATENT AND TRADEMARK OFFICE

CERTIFICATE OF CORRECTION

PATENT NO. : 5,444,472

DATED : 8/22/95

INVENTOR(S) : George B. Dué et al.

It is certified that error appears in the above-indentified patent and that said Letters Patent is hereby corrected as shown below:

Column 1, line 48, delete the period after present.

Column 10, line 62, delete "a".

Signed and Sealed this

Twenty-first Day of November, 1995

*Attest:*

Bruce Lehman

BRUCE LEHMAN

*Attesting Officer*

*Commissioner of Patents and Trademarks*